United States Patent [19]

Sisco

[11] Patent Number: 4,519,148

[45] Date of Patent: May 28, 1985

[54] EXERCISE SHOE

[76] Inventor: Jann L. Sisco, 819 Country Club Dr., Sonoma, Calif. 94576

[21] Appl. No.: 514,873

[22] Filed: Jul. 18, 1983

[51] Int. Cl.[3] ..... A43B 7/22

[52] U.S. Cl. ..... 36/91; 36/103; 36/113; 36/8.3; 128/606

[58] Field of Search ..... 36/8.3, 28, 31, 32 R, 36/43, 55, 69, 91, 92, 102, 103, 113, 68, 9 R; 128/586, 605, 606

[56] References Cited

U.S. PATENT DOCUMENTS

| | | | |
|---|---|---|---|
| 1,659,171 | 2/1928 | Spafford | 128/606 |
| 1,844,885 | 2/1932 | Harris | 36/113 X |
| 1,852,660 | 4/1932 | Laisure | 128/606 |
| 2,110,890 | 3/1938 | Paul | 36/113 X |
| 2,252,315 | 8/1941 | Dorée | 36/102 X |
| 2,307,416 | 1/1943 | Margolin | 36/43 X |
| 2,415,580 | 2/1947 | Davis | 36/43 X |
| 2,619,743 | 12/1952 | Harris | 36/113 X |
| 2,845,723 | 8/1958 | Arnold | 36/9 R |
| 2,926,433 | 3/1960 | Kramer | 36/9 R |
| 3,416,174 | 12/1968 | Novitske | 36/9 R |
| 4,308,673 | 1/1982 | Möbius | 36/68 |

*Primary Examiner*—Werner H. Schroeder
*Assistant Examiner*—T. G. Graveline
*Attorney, Agent, or Firm*—Willis E. Higgins

[57] ABSTRACT

An exercise shoe (10) has an upper (14) and a sole (18) fastened to the upper. The sole (18) has first and second impervious, surface gripping portions (20, 22). The portions (20, 22) are separated by a third, moisture-penetrable fabric sole portion (24). The interior of the shoe (10) includes a terrycloth layer (54) for moisture absorption. An ankle strap (26) extends from upper rear (32) of heel (34), forward around a wearer's ankle (36) above the shoe (10). A body (56) of cushioning material is located between the terrycloth layer (54) and sole (18). Cushioning body (56) terminates at (58), behind a wearer's toes (60) and protects ball (62) of a wearer's foot (12).

15 Claims, 7 Drawing Figures

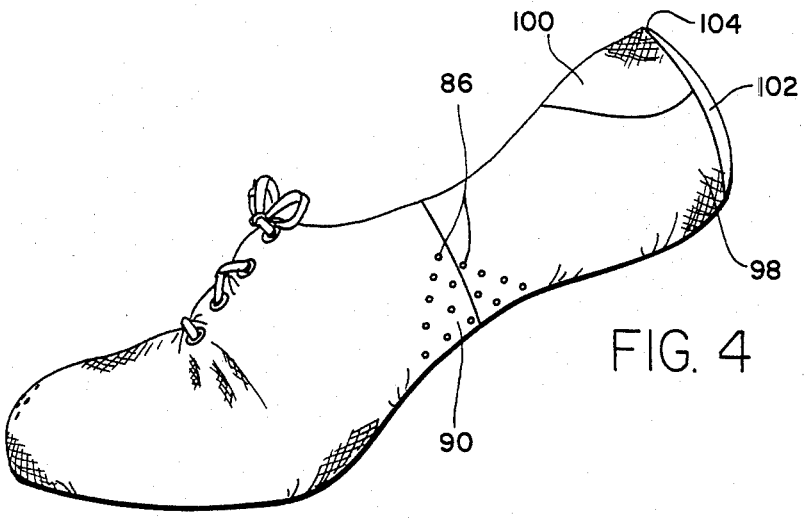
FIG. 4
FIG. 5
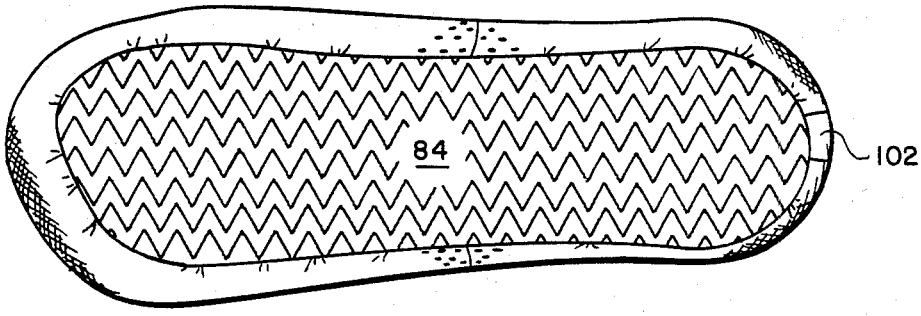
FIG. 6
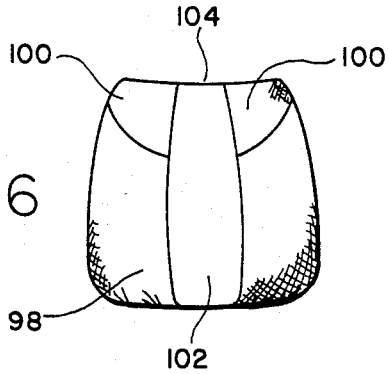
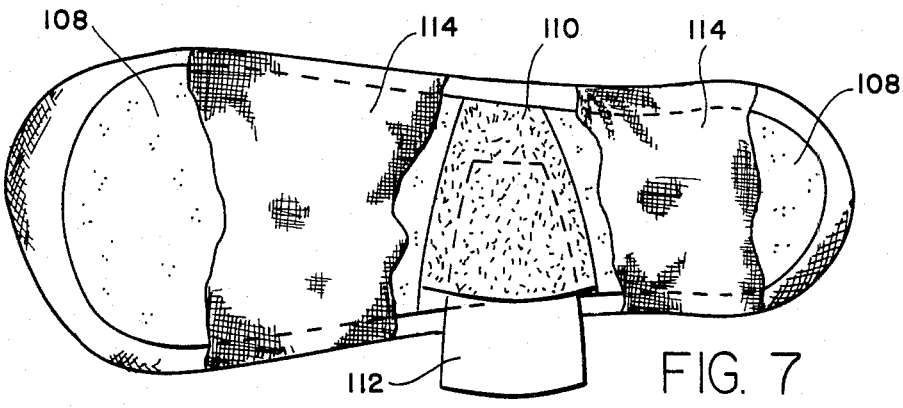
FIG. 7

EXERCISE SHOE

BACKGROUND OF THE INVENTION

1. Field of the Invention

This invention relates to a novel exercise shoe especially adapted for aerobic exercises and gymnastic routines. More particularly, it relates to improvements in sole, insole, and upper construction of an exercise shoe, which is especially adapted for aerobic dancing exercises and gymnastic routines, but which may be used for other types of exercises as well.

2. Description of the Prior Art

There is a wide variety of exercise shoe and related designs known in the prior art. For example, the following issued U.S. patents disclose various exercise shoe and related designs: U.S. Pat. Nos. 1,154,054; 2,619,743; 2,683,316; 3,793,748; 4,254,563; 4,272,899; 4,277,897; and 4,294,023. Particularly with current increased interest in exercise and physical fitness, there is a corresponding increased interest in exercise shoe designs.

A comparatively recent phenomenon has been the development of aerobic dancing exercise sessions, such as commercially available under the "Jazzercise" name, and similar programs. Aerobic dance routines incorporate certain characteristic foot movements which vary for different routines. Also, many of these movements are also performed in other forms of exercise, including various gymnastic routines, competition beam, floor, jumping, and the like.

While the art relating to exercise shoe designs is a well developed one, a need remains for further improvements in shoe design for carrying out these and related exercises.

SUMMARY OF THE INVENTION

Accordingly, it is an object of this invention to provide an exercise shoe design especially adapted for aerobic dancing and gymnastic routines.

It is another object of the invention to provide such an exercise shoe which will provide an increased level of protection against foot, lower leg and knee injury, without interfering with effective performance of aerobic dance and gymnastic movements.

It is another object of the invention to provide an exercise shoe with an improved sole design that provides enhanced gripping of surfaces contacted by the sole, while allowing a wearer's feet to feel a surface on which exercise routines are being performed.

It is a further object of the invention to provide an exercise shoe with enhanced protection for fat pads under each bone of the ball of the foot, while allowing a wearer's toes to feel a surface on which exercise routines are performed.

It is a still further object of the invention to provide an exercise shoe in which a wearer's feet are less prone to become overheated during strenuous exercise routines.

It is yet another object of the invention to provide an exercise shoe with improved retention in a proper position on a wearer's foot during strenuous exercise routines.

The attainment of these and related objects may be achieved through use of the novel exercise shoe herein disclosed. In one aspect of the invention, an exercise shoe in accordance with the invention has an upper and a sole fastened to the upper. The sole has first and second impervious, surface gripping sole portions. The first and second sole portions are separated by a third, moisture penetrable fabric sole portion. In another aspect of the invention, an exercise shoe in accordance with the invention has an upper and a sole fastened to the upper. A soft, absorbent fabric inner layer, such as a terrycloth inner layer, is placed inside the shoe to contact a wearer's foot. In another aspect of the invention, the exercise shoe has an ankle strap extending from an upper rear heel portion of the shoe upper. The strap is dimensioned and configured to extend from the upper rear heel portion forward around a wearer's ankle above the shoe. In a further aspect of the invention the shoe upper is formed of a soft material and has a stiff material heel reinforcement applied to opposing upper outside edges of a heel portion of the upper. Another aspect of the invention is a body of cushioning material positioned to be between the sole and at least a ball of a wearer's foot. The cushioning material terminates short of a toe end of the shoe. A still further aspect of the invention includes a pocket on the body of the cushioning material positioned and configured to contain a removable arch support. An arch support is removably inserted in the pocket. Improved exercise shoe designs in accordance with the invention desirably incorporate various combinations of the above features.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 4 is a side view of the exercise shoe shown in FIG. 3.

FIG. 5 is a bottom view of the exercise shoe shown in FIGS. 3–4.

FIG. 6 is a back view of the exercise shoe shown in FIGS. 3–5.

FIG. 7 is an interior plan view of the exercise shoe shown in FIGS. 3–6, with partial cutaways to show detail.

DETAILED DESCRIPTION OF THE INVENTION

Figure 1:
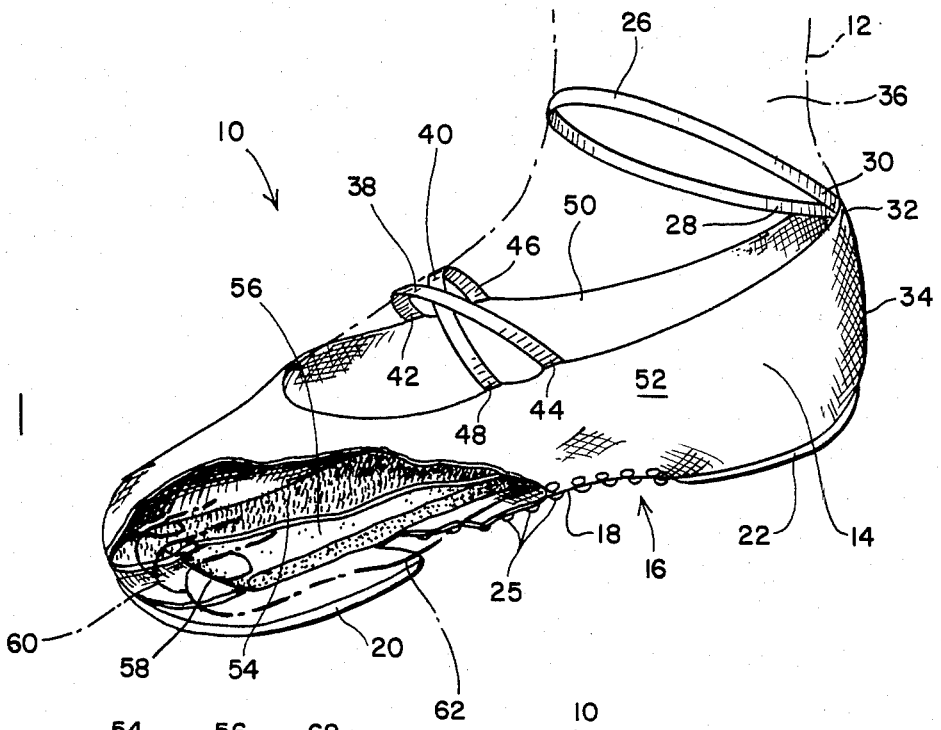
FIG. 1 is a perspective view of an exercise shoe in accordance with the invention, with partial cutaways to show interior detail.
Figure 2:
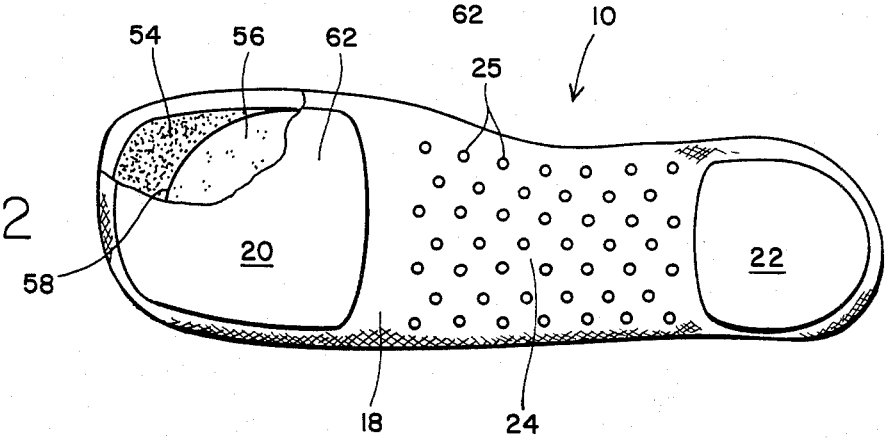
FIG. 2 is a bottom view of the exercise shoe shown in FIG. 1.
Figure 3:
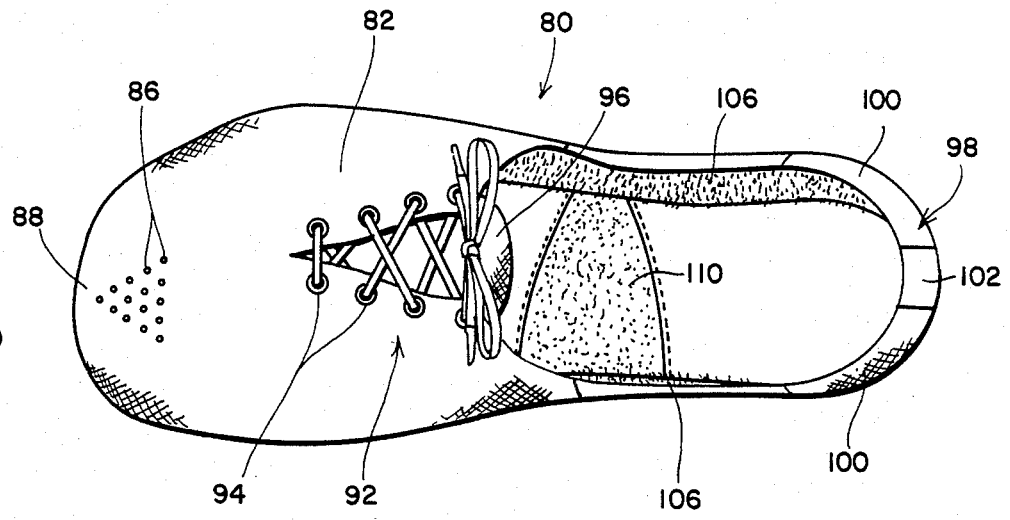
FIG. 3 is a top view of another embodiment of an exercise shoe in accordance with the invention.

Turning now to the drawings, more particularly to FIGS. 1 and 2, there is shown an exercise shoe 10 in accordance with the invention in place on a wearer's foot 12. The shoe 10 has a soft fabric or animal skin, i.e., leather upper 14 sewed or otherwise fastened around its bottom 16 to a porous, soft fabric or animal skin sole 18. Rubber or similar smooth, surface gripping material sections 20 and 22 are respectively adhesively bonded to the heel and ball through toe areas of the sole 18. In practice, the sections 20 and 22 may be fabricated by placing thin rings of rubber at the heel and ball of sole 18, then covering the rings with a layer of rubber cement to give the finished sections 20 and 22. Rubber sections 20 and 22 may also simply be cemented in place. The center portion 24 of the sole 18 is left exposed. If desired, the fabric center portion 24 may have small rubber or similar nodules 25 on its surface, for enhanced gripping of exercise surfaces. An elastic ankle strap 26 has two ends 28 and 30 fastened to the upper rear 32 of heel portion 34 of the upper 14, to form a loop of the elastic material. If desired, the ankle strap may be separated into two portions which fasten together around the wearer's ankle 36. As shown, the ankle strap 26 extends forward from the upper rear 32 of heel 34 around the wearer's ankle 36 above shoe 10. Crossing straps 38 and 40 are respectively fastened at 42 and 44 and 46 and 48 to opposing sides 50 and 52 of the upper 14.

In the interior of the shoe 10, a terrycloth or other soft absorbent fabric inner sole 54 contacts the bottom of the wearer's foot 12. A body 56 of commercially available EVA medium density cushioning material is positioned between the inner sole 54 and sole 18. The cushioning body 56 terminates at 58, behind the wearer's toes 60. In the form shown, the body 56 extends over the remainder of sole 18, but it need only cover ball 62 of the wearer's foot 12, in order to protect natural fat pads located under each bone in the ball 62 of the wearer's foot. The wearer's toes 60 are able to feel a floor or other surface on which exercise routines are performed while wearing the shoe 10.

In use, the ankle strap 26 serves to retain the heel 34 of the shoe 10 in proper position during the execution of strenuous routines, especially those involving a substantial amount of stretching. The straps 38 and 40 further aid in retaining the shoe 10 in the proper position on foot 12. The terrycloth inner sole 54 absorbs moisture to keep the foot dry during strenuous activity. The sections 20 and 22 provide improved gripping of smooth surfaces on which exercises are performed. The exposed center portion 24 of the sole 18 provides a different type of surface contact, desirable for other types of exercise surfaces and certain exercise routines. The ability of the wearer to feel exercise surfaces with toes 60 is advantageous for certain aerobic dance and gymnastic routines.

Turning now to FIGS. 3–7, another exercise shoe 80 in accordance with the invention is shown. Upper 82 of the shoe 80 wraps around for attachment to sole 84 of the shoe 80. As in the FIGS. 1–2 embodiment, the upper 82 is formed from a soft, porous fabric or animal skin. The sole 84 is formed from a textured, pliable, non-skid material, such as rubber. Sole 84 should provide a non-skid sole with a minimum restriction of movement. Upper 82 of the shoe 80 has a plurality of air holes 86 located in toe 88 and arch 90 of the shoe. Upper 82 incorporates a conventional lace closure 92 with reinforced eyelets 94, and a cushioned tongue 96. Heel 98 of the shoe 80 has reinforcing portions 100 of a strong, stiff material, such as vinyl or other plastic stitched to the outside of upper 82. An additional strip 102 of the stiff reinforcing material extends from top 104 of heel 98 to sole 84.

In the interior of shoe 80, a terrycloth or other soft, absorbent fabric layer 106 is provided on the interior sides of the shoe for moisture absorption. A body 108 of EVA medium density cushioning material is provided between the sole 84 and a wearer's foot, as in the FIG. 1–2 shoe. The body 108 also terminates behind a wearer's toes, in order to allow the wearer to feel an exercise surface with the toes. A commercially available Spenco type insole 114 is provided over the cushioning body 108. The Spenco insole 114 has a top layer of soft, light weight, woven fabric and a bottom layer of spongy, non-compressable rubber, which absorbs a large proportion of all shock transmitted into the shoe during use. A stretchable, absorbent fabric pocket 110 is fastened to the upper surface of body 108. Alternatively, the fabric pocket 110 can form part of the insole 114, facing the cushioning body 108. A non-compressable, cork-rubber composite arch support 112 is inserted in the fabric pocket 110. The arch support 112 is removable, so that different sized arch supports can be provided for different arch configurations. The fabric pocket 110 is desirably formed from stretchable terrycloth, and the arch support 112 is fabricated from commercially available Korex or similar cork-rubber material.

In use, the heel reinforcements 100 and 102 assist conventional closure 92 in retaining the shoe 80 in proper position on the wearer's foot. Both the shock absorbent insole 114 and the cushioning body 108 protect the fat pads of the wearer's foot. The variable thickness arch support 112 allows better fit of the shoe to different feet. The wraparound upper 82 alleviates ankle injury due to rolling off of shoes with a conventional sole design. The terrycloth lining 106, terrycloth arch support pocket 110 and the air holes 86 remove moisture from the wearer's foot.

It should now be readily apparent to those skilled in the art that a novel exercise shoe design capable of achieving the stated objects of the invention has been provided. The shoe of this invention provides an increased level of protection against foot, lower leg and knee injury, without interfering with effective performance of aerobic dance and gymnastic movements. The shoe incorporates an improved sole design and shock protection that provides enhanced gripping of surfaces contacted by the sole, while allowing a wearer's foot to feel a surface on which exercise routines are being performed. The shoe incorporates structure to provide improved retention in a proper position on a wearer's foot during strenuous exercise routines. The shoe construction also reduces overheating and moisture on the wearer's foot during such routines. While the features of an exercise shoe in accordance with this invention make it especially adapted for aerobic dancing and gymnastic routines, the desirable features of this shoe should find wide application in other environments as well.

It should further be apparent to those skilled in the art that various changes in form and details of the invention as shown and described may be made. It is intended that such changes be included within the spirit and scope of the claims appended hereto.

What is claimed is:

1. An exercise shoe, which comprises an upper and a sole fastened to said upper, said sole comprising first and second surface-gripping sole portions, said first and second sole portions being separated by a third, moisture-penetrable fabric sole portion, and a body of shock absorbent cushioning material positioned to be between said sole and at least a ball of a wearer's foot, said cushioning material terminating short of a toe end of said sole.

2. The exercise shoe of claim 1 additionally comprising an ankle strap extending from an upper rear heel portion of said upper, said strap being dimensioned and configured to extend forward around a wearer's ankle above said shoe.

3. The exercise shoe of claim 1 in which said first and second sole portions are formed from rubber sections adhesively fastened to a fabric layer, said fabric layer constituting said third sole portion.

4. The exercise shoe of claim 1 additionally comprising a soft absorbent fabric inner layer located inside said shoe to contact a wearer's foot.

5. The exercise shoe of claim 4 additionally comprising an ankle strap extending from an upper rear heel portion of said upper, said strap being dimensioned and configured to extend forward around a wearer's ankle above said shoe.

6. The exercise shoe of claim 4 in which said inner layer is of terrycloth.

7. The exercise shoe of claim 6 in which said inner layer is an inner sole of said shoe.

8. The exercise shoe of claim 6 in which said inner layer is located along sides of said upper.

9. An exercise shoe comprising an upper, a soft sole fastened to said upper, an insole positioned to contact a wearer's foot, a body of shock absorbent cushioning material positioned to be between said soft sole and said insole at least at a ball of the wearer's foot, said cushioning material terminating short of a toe end of said soft sole, said insole being further provided as a pocket resting on said body of shock absorbent cushioning material for holding a removable arch support, and a removable arch support in the pocket.

10. An exercise shoe, which comprises an upper, a sole fastened to said upper, and a body of cushioning material positioned to be between said sole and at least a ball of a wearer's foot, said body of cushioning material terminating short of a toe end of said shoe, an insole formed from a springy, non-compressible material positioned to be between said sole and a wearer's foot bottom, said insole having a pocket positioned against said body of cushioning material and configured to contain a removable arch support, and an arch support removably inserted in said pocket.

11. The exercise shoe of claim 10 additionally comprising a layer of soft, absorbent fabric positioned to be between said body of cushioning material and a wearer's foot bottom.

12. The exercise shoe of claim 11 in which said fabric layer is terrycloth.

13. The exercise shoe of claim 10 in which said arch support is formed from non-compressible cork-rubber material.

14. The exercise shoe of claim 10 in which said pocket is formed from a stretchable, absorbent fabric.

15. The exercise shoe of claim 10 in which said upper is formed from a soft material and has a stiff material heel reinforcement applied to opposing upper edges of a heel portion of said upper.

* * * * *